US007037151B1

(12) United States Patent
Fan

(10) Patent No.: US 7,037,151 B1
(45) Date of Patent: May 2, 2006

(54) OAR

(76) Inventor: Po-Hsun Fan, 5F., No. 28, Lane 200, Sec. 2, Lung Mi Rd., Pa Li Hsiang, Taipei Hsien (TW)

( * ) Notice: Subject to any disclaimer, the term of this patent is extended or adjusted under 35 U.S.C. 154(b) by 0 days.

(21) Appl. No.: 11/179,587

(22) Filed: Jul. 13, 2005

(51) Int. Cl.
*B63H 16/04* (2006.01)

(52) U.S. Cl. ..... 440/101; 416/74

(58) Field of Classification Search ..... 440/101, 440/102; 416/69, 74

See application file for complete search history.

(56) References Cited

U.S. PATENT DOCUMENTS

| | | | | | |
|---|---|---|---|---|---|
| 817,810 | A | * | 4/1906 | Sheen | 416/68 |
| 1,066,662 | A | * | 7/1913 | Schmidt., Jr | 416/74 |
| 1,324,397 | A | * | 12/1919 | Hobart | 416/74 |
| 3,025,538 | A | * | 3/1962 | Noland | 416/62 |
| 4,098,219 | A | * | 7/1978 | Tesan | 440/101 |
| 4,892,493 | A | * | 1/1990 | Gil | 440/17 |
| 5,041,037 | A | * | 8/1991 | Jaw | 440/102 |

* cited by examiner

*Primary Examiner*—Lars A. Olson
(74) *Attorney, Agent, or Firm*—Leong C. Lei

(57) ABSTRACT

Disclosed is an oar, which has a supplementary blade pivotally connected to one end of the blade adjacent to the shaft thereof to increase the area of the water expelling surface, enhancing the rowing efficiency.

2 Claims, 4 Drawing Sheets

OAR

BACKGROUND OF THE INVENTION (a) Technical Field of the Invention

The present invention relates to an oar for rowboat and more particularly, to such an oar, which is equipped with a pivoted supplementary blade to enhance the rowing.

(b) Description of the Prior Art

When rowing a rowboat, an oar or two oars shall be used. An oar for this purpose comprises a shaft, a grip fixedly provided at one end of the shaft, and a flat blade fixedly provided at the other end of the shaft. For comfortable gripping of the hand, the grip of an oar is made in a cylindrical shape. When rowing a rowboat, the user who sits in the rowboat must insert the blade of the oar into the water and then move the oar to force the blade against the water, and then lift the oar from the water, and then repeat the rowing procedure again and again. When forcing the blade against the water, a resisting force is produced to move the rowboat on the water.

A person who learned fluid mechanics or mechanics knows that the wider the area of the water expelling surface of an oar is the greater the water resisting force will be, i.e., an oar having a relative bigger blade surface area can move the rowboat on the water more quickly. However, it requires much effort to row an oar having a relatively greater blade surface area.

SUMMARY OF THE INVENTION

The primary purpose of the present invention is to provide an oar, which enhances the rowing efficiency by: increasing the pressure bearing surface of the blade when rowing the oar against the water and reducing the pressure bearing surface of the blade when lifting the oar from the water. According to one aspect of the present invention, the oar comprises a shaft, a fixed blade axially extending from one end of the shaft, and a supplementary blade pivotally connected to the connection area between the blade and the shaft and turns relative to the fixed blade between a received position and an extended position. The supplementary blade is received to the fixed blade without increasing the water resisting force when the user lifts the oar from the water during rowing. The supplementary blade is turned outwards from the fixed blade to the extended position to increase the pressure bearing surface (water expelling surface) of the oar, when the user rowing the oar against the water, thereby enhancing the rowing efficiency. According to another aspect of the present invention, a constraint member is provided to limit the turning angle of the supplementary blade relative to the fixed blade to a predetermined range. Preferably, the turning angle is within 90°~180°. The constraint member can be a soft cord member connected between the fixed blade and the supplementary blade. Alternatively, the constraint member can be a stop rod fixedly provided at the connection area between the fixed blade and the shaft.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
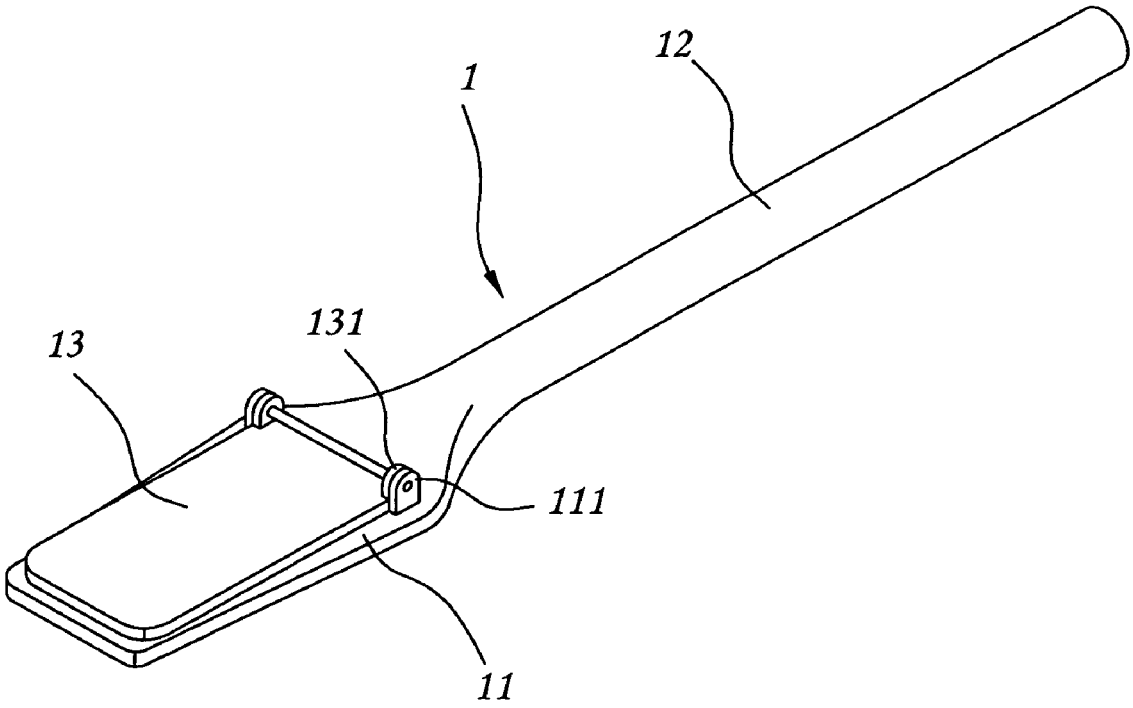
FIG. 1 is an elevated view of an oar according to the present invention.

Referring to FIG. 1, an oar 1 in accordance with the present invention is shown comprising a shaft 12, a fixed main blade 11 extended from one end, namely, the bottom end of the shaft 12, and a movable supplementary blade 13 pivotally connected to the main blade 11 adjacent to the shaft 12. The supplementary blade 13 can be turned between a received position where the contained angle between the main blade 11 and the supplementary blade 13 is zero, and an extended position where the contained angle between the main blade 11 and the supplementary blade 13 is within 180° but greater than 90°.

The main blade 11 has two lugs 111 arranged in parallel at one side thereof adjacent to the shaft 12. The supplementary blade 13 has two lugs 131 disposed at two opposite lateral sides near one end thereof and pivotally connected to the lugs 111 of the main blade 11 with a pivot.

Figure 2:
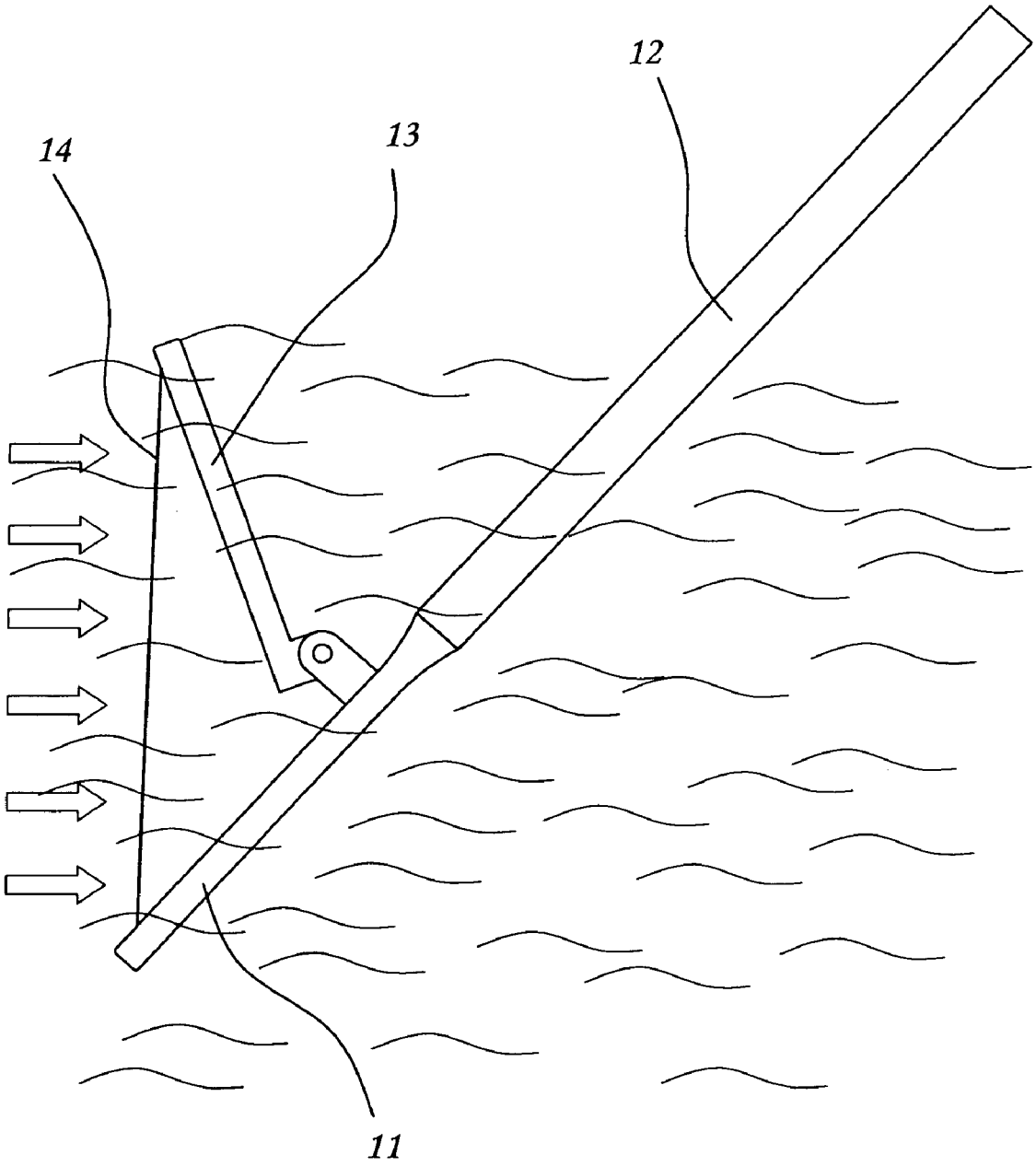
FIG. 2 is a schematic drawing showing the supplementary blade turned outwards from the received position to the extended position during rowing of the oar according to the present invention.

Referring to FIG. 2, a constraint member, for example, a cord member 14 is connected between the main blade 11 and the supplementary blade 13 to limit the maximum turning angle of the supplementary blade 13 relative to the main blade 11 to the aforesaid extended position.

Figure 4:
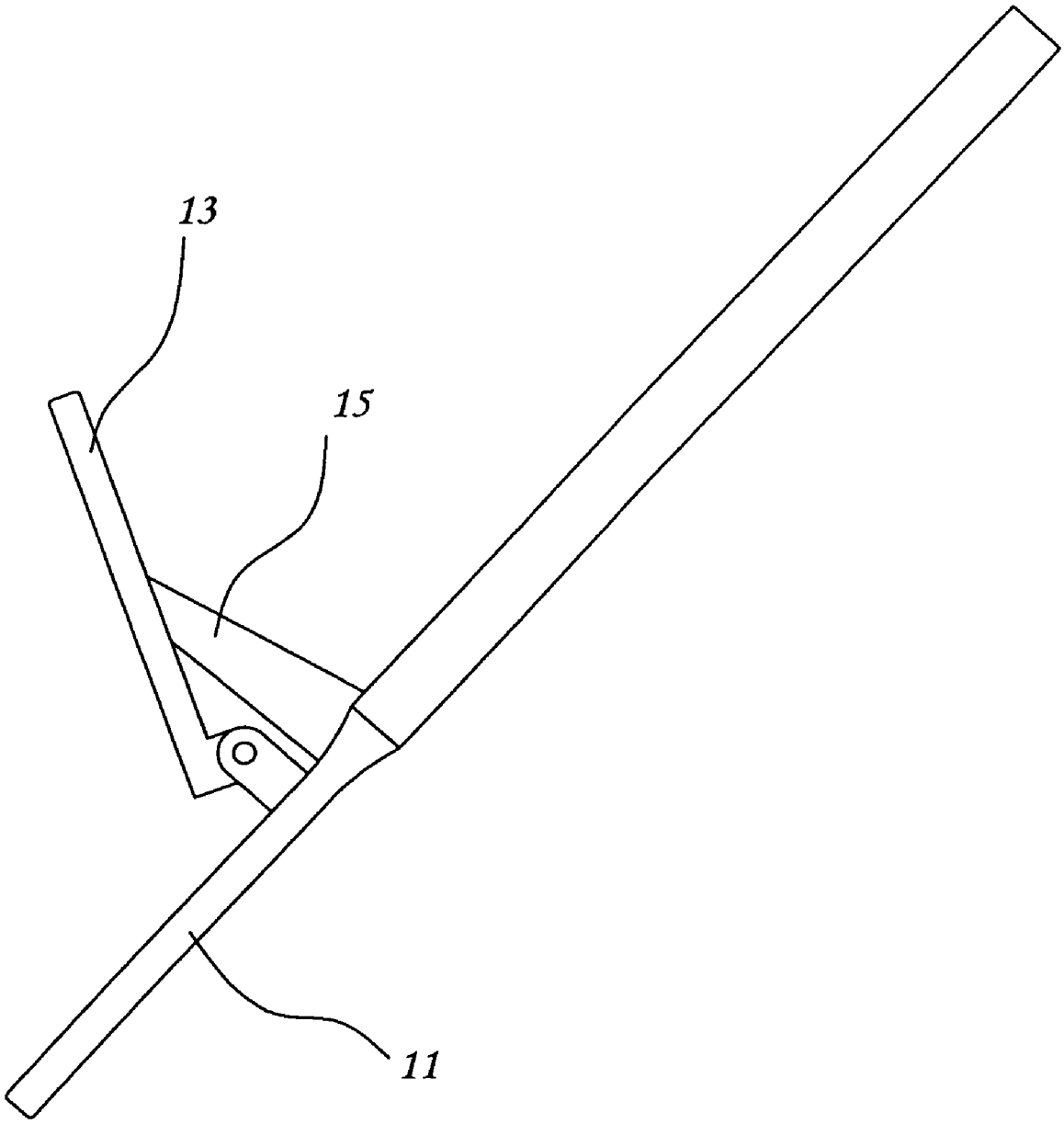
FIG. 4 is a schematic drawing showing an alternate form of the oar according to the present invention.

FIG. 4 shows an alternate form of the present invention. According to this embodiment, the constraint member is a stop rod 15 fixedly provided at the connection area between the main blade 11 and the shaft 12 and adapted to stop the supplementary blade 13 when the supplementary blade 13 is turned outwards from the main blade 11 to the aforesaid extended position.

Referring to FIG. 2 again, when rowing the oar 1 to force the main blade 11 against the water and to further move the rowboat on the water, the supplementary blade 13 is forced outwards from the main blade 11 by the resisting force of the water to the extent that the cord member 14 or stop rod 15 stop the supplementary blade 13 in the extended position. At this time, the main blade 11 and the supplementary blade 13 provide a big area of water expelling surface, producing a relatively greater force to move the rowboat forwards.

Figure 3:
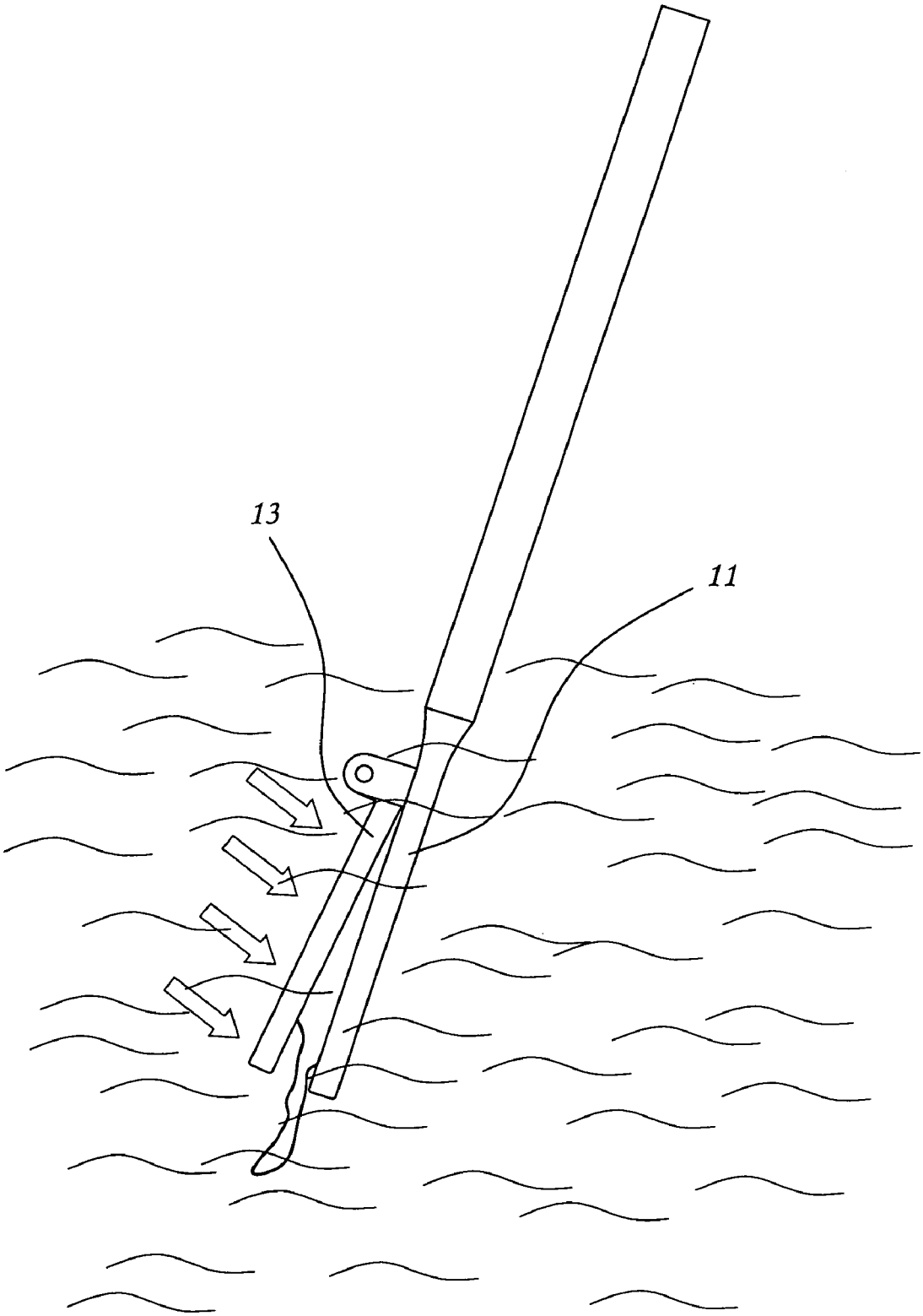
FIG. 3 is a schematic drawing showing the supplementary blade moved from the extended position toward the received position during rowing of the oar according to the present invention.

Referring to FIG. 3, when the user lifting the main blade 11 out of the water during rowing, the supplementary blade 13 is forced toward the main blade 11 by the water, thereby reducing the water resisting force, and therefore the user can lift the main blade 11 and the supplementary blade 13 from the water with less effort.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An oar comprising a shaft and a fixed blade axially extended from one end of said shaft, a movable supplementary blade pivotally connected to a back side of said fixed blade adjacent to said shaft and being able to turn between a received position where a contained angle between said fixed blade and said supplementary blade is zero and an extended position where a contained angle between said fixed blade and said supplementary blade is within 180 degrees but greater than 90 degrees, said fixed blade having two lugs arranged in parallel at one side thereof adjacent to said shaft, said supplementary blade having two lugs disposed at two opposite lateral sides near one end thereof and pivotally connected to said lugs of said fixed blade with a pivot, a constraint member connected between said fixed blade and said supplementary blade to limit a maximum turning angle of said supplementary blade relative to said fixed blade to said extended position.

2. The oar as claimed in claim 1, wherein said constraint member is a stop rod fixedly provided at the connection area between said fixed blade and said shaft.

* * * * *